US009579703B2

(12) United States Patent
Morreale et al.

(10) Patent No.: US 9,579,703 B2
(45) Date of Patent: Feb. 28, 2017

(54) ROLL CHANGE APPARATUS

(71) Applicant: Fives Bronx, Inc., North Canton, OH (US)

(72) Inventors: Armando F. Morreale, Pittsburgh, PA (US); Edward A. Dray, Uniontown, OH (US); Mark E. Lukowski, Minerva, OH (US)

(73) Assignee: FIVES BRONX, INC., North Canton, OH (US)

( * ) Notice: Subject to any disclaimer, the term of this patent is extended or adjusted under 35 U.S.C. 154(b) by 0 days.

(21) Appl. No.: 14/500,622

(22) Filed: Sep. 29, 2014

(65) Prior Publication Data

US 2015/0089988 A1 Apr. 2, 2015

Related U.S. Application Data

(60) Provisional application No. 61/885,820, filed on Oct. 2, 2013.

(51) Int. Cl.
*B21B 31/10* (2006.01)
*B21B 19/10* (2006.01)

(52) U.S. Cl.
CPC ..... *B21B 31/103* (2013.01); *B21B 19/10* (2013.01); *B21B 2203/06* (2013.01)

(58) Field of Classification Search
CPC ..... B21B 31/08; B21B 31/10; B21B 31/103; B21B 31/12; B21B 2203/06; B21B 19/10
USPC ..... 72/237–239
See application file for complete search history.

(56) References Cited

U.S. PATENT DOCUMENTS 2,037,210 A 4/1936 Buente
2,852,065 A 9/1958 Peterson
3,221,530 A 12/1965 Swallow et al.
3,491,570 A * 1/1970 Beard ..... B21B 31/103 72/239
3,611,779 A * 10/1971 Simmonds ..... B21B 31/103 72/239
3,618,355 A 11/1971 Brahm et al.
(Continued)

FOREIGN PATENT DOCUMENTS

CN 202845508 U 4/2013
GB 1434438 A 5/1976
(Continued)

OTHER PUBLICATIONS

International Search Report with Written Opinion.

*Primary Examiner* — Moshe Wilensky
*Assistant Examiner* — Pradeep C Battula
(74) *Attorney, Agent, or Firm* — Benesch, Friedlander, Coplan & Aronoff LLP

(57) ABSTRACT

A rolling machine has pairs of rolls in a horizontal line of roll pair locations, with each pair including upper and lower rolls opposed across a vertical gap. A sliding frame is mounted on the rolling machine for movement alongside the rolling machine in a direction parallel to the line of roll pair locations. A lifting frame is mounted on the sliding frame for movement vertically relative to the sliding frame beside each of the roll pair locations. Other parts include a roll cassette and a load tray. The load tray is configured to carry the roll cassette, and is mounted on the lifting frame for movement relative to the lifting frame transversely into the vertical gap between the rolls at each roll pair location.

10 Claims, 12 Drawing Sheets

(56) References Cited

U.S. PATENT DOCUMENTS

| | | | | | |
|---|---|---|---|---|---|
| 3,623,348 | A | | 11/1971 | Thompson et al. | |
| 3,665,746 | A | * | 5/1972 | Eibe | B21B 1/12 72/239 |
| 3,675,456 | A | | 7/1972 | Sieurin | |
| 3,805,572 | A | | 4/1974 | Busch | |
| 3,979,939 | A | | 9/1976 | Pazderka | |
| 4,005,594 | A | | 2/1977 | Reth et al. | |
| 4,222,258 | A | * | 9/1980 | Field | B21B 31/10 72/239 |
| 4,435,970 | A | * | 3/1984 | Sekiya | B21B 31/103 72/238 |
| 4,512,173 | A | | 4/1985 | Brauer et al. | |
| 4,534,197 | A | | 8/1985 | Woolley | |
| 4,565,083 | A | * | 1/1986 | Thompson | B21D 3/04 72/98 |
| 4,726,108 | A | | 2/1988 | Poloni | |
| 4,763,504 | A | | 8/1988 | Nilsson | |
| 4,771,626 | A | | 9/1988 | Ichida et al. | |
| 5,590,557 | A | | 1/1997 | Keller et al. | |
| 5,595,083 | A | * | 1/1997 | Shore | B21B 31/103 72/234 |
| 5,823,036 | A | * | 10/1998 | Matsunaga | B21D 5/12 72/181 |
| 5,875,671 | A | | 3/1999 | Hauck et al. | |
| 5,887,472 | A | | 3/1999 | Abbey, III | |
| 6,098,439 | A | | 8/2000 | Lecrivain | |
| 6,167,738 | B1 | | 1/2001 | Horold et al. | |
| 6,397,924 | B1 | | 6/2002 | Fish et al. | |
| 6,408,667 | B1 | * | 6/2002 | de Jesus, Jr. | B21B 31/103 72/239 |
| 6,425,278 | B1 | * | 7/2002 | Aratani | B21B 31/103 72/239 |
| 6,546,772 | B2 | | 4/2003 | Hoffgen et al. | |
| 6,550,741 | B1 | | 4/2003 | Cottone | |
| 6,672,124 | B2 | * | 1/2004 | Minnerop | B21B 31/103 72/239 |
| 6,763,565 | B2 | | 7/2004 | Mukaigawa et al. | |
| 7,302,820 | B2 | * | 12/2007 | Le Viavant | B21B 13/001 72/237 |
| 7,698,923 | B2 | * | 4/2010 | Rackel | B21B 31/103 72/239 |
| 8,210,013 | B2 | * | 7/2012 | Rossigneux | B21B 31/103 72/239 |
| 9,061,334 | B2 | * | 6/2015 | Bender | B21B 31/103 |
| 9,180,507 | B2 | * | 11/2015 | Yabuta | B21D 3/05 |
| 9,511,400 | B2 | * | 12/2016 | Charre | B21B 31/103 |
| 2006/0144114 | A1 | * | 7/2006 | Benner | B21B 31/103 72/239 |
| 2009/0019909 | A1 | * | 1/2009 | Blecher | B21B 31/103 72/238 |

FOREIGN PATENT DOCUMENTS

| | | | |
|---|---|---|---|
| JP | 55057311 | A | 4/1980 |
| JP | 56050713 | A | 5/1981 |
| JP | 02160118 | A | 6/1990 |
| JP | 03260118 | A | 6/1990 |
| KR | 1020010046726 | A | 6/2001 |
| KR | 1020030055603 | A | 7/2003 |

* cited by examiner

ROLL CHANGE APPARATUS

RELATED APPLICATIONS

This application claims the benefit of priority to provisional U.S. Patent Application 61/885,820, filed Oct. 2, 2013, which is incorporated by reference.

TECHNICAL FIELD

This technology relates to a rolling machine for processing an elongated workpiece, and relates particularly to an apparatus for changing rolls in a rolling machine.

BACKGROUND

An elongated workpiece may need to be processed uniformly along its length. This can be accomplished by driving the workpiece through a rolling machine. For example, a pipe or other tubular structure may need to be straightened, and certain rolling machines are configured to function as straightening machines. One such machine is shown is shown in FIGS. 1 and 2.

In the illustrated example, the straightening machine 10 has a base 12 and a crown 14. The base 12 stands on a shop floor 16. The crown 14 is supported on pillars 18 at a fixed height above the base 12. Both the base 12 and the crown 14 have a rectangular shape with opposite ends 20 and 22, a drive side 24, and an operator side 26.

The machine 10 further has hyperbolically shaped straightening rolls 34 and 36 between the base 12 and the crown 14. The rolls 34 and 36 are arranged in pairs that are spaced apart in a horizontal line of roll pair locations 39 reaching along the length of the machine 10. The given example is a six roll machine with three pairs of rolls, each of which includes an upper roll 34 and a lower roll 36. The upper and lower roll 34 and 36 in each pair are opposed across a vertical gap between them.

The rolls 34 and 36 are supported on the crown 14 and the base 12 for relative movement into and out of operative positions. When in the operative positions, the rolls 34 and 36 in each pair are skewed horizontally relative to one another, and the vertical gap has a reduced size defining a nip for receiving a workpiece between the rolls 34 and 36.

As shown in FIG. 2, each roll 34 and 36 is coupled to a respective drive shaft 40 at the drive side 24 of the machine 10. The drive shafts 40 project from the rolls 34 and 36 to respective motors in a drive assembly (not shown) that is mounted on the floor 16 separately from the machine 10. In operation, the rolls 34 and 36 are rotated by the drive shafts 40 to move a tube or other elongated workpiece through the nips along the line of roll pair locations 39. This straightens the workpiece as the skewed concave surfaces of the rolls 34 and 36 force the workpiece onto a working axis at each nip.

SUMMARY

An apparatus is configured for changing rolls in a rolling machine. In a given example, a sliding frame is mounted on a rolling machine for movement alongside the rolling machine in a direction parallel to the line of roll pair locations. A lifting frame is mounted on the sliding frame for movement vertically relative to the sliding frame beside each of the roll pair locations. Other parts include a roll cassette and a load tray. The roll cassette is configured for attachment and detachment with an upper roll from beneath the upper roll, and for attachment and detachment with a lower roll from above the lower roll. The load tray is configured to carry the roll cassette, and is mounted on the lifting frame for movement relative to the lifting frame transversely across the line of roll pair locations. In this manner the load tray can carry the cassette horizontally into the vertical gap between the rolls at each roll pair location.

The roll cassette may have a first rest pad surface. The load tray may have a second rest pad surface configured to support the roll cassette in a seated position with the second rest pad surface resting on the first rest pad surface. The rest pad surfaces preferably have contours providing rolling contact between the roll cassette and the load tray when the roll cassette is in the seated position.

Summarized differently, an apparatus is configured for use with an upper and a lower roll having skewed axes of rotation and concave axial profiles opposed across a vertical gap. In a given example, each roll also has bearing housings at its opposite ends. The apparatus includes a roll cassette with upper and lower plates supported for movement relative to each other pivotally about a vertical axis. When the plates are in pivotally aligned positions, they are movable together horizontally into the vertical gap between the upper and lower rolls.

The upper plate has an upper portion configured to mate with a bearing housing at one end of the upper roll. That portion of the upper plate has an arched surface profile protruding upward. The lower plate has a lower portion configured to mate with a bearing housing at one end of the lower roll. That portion of the lower plate has an arched surface profile protruding downward.

DETAILED DESCRIPTION

The following description presents examples of how a person of ordinary skill in the art can make and use the claimed invention. It is intended to meet the requirements of written description, enablement and best mode without imposing limitations that are not recited in the claims.

Figure 1:
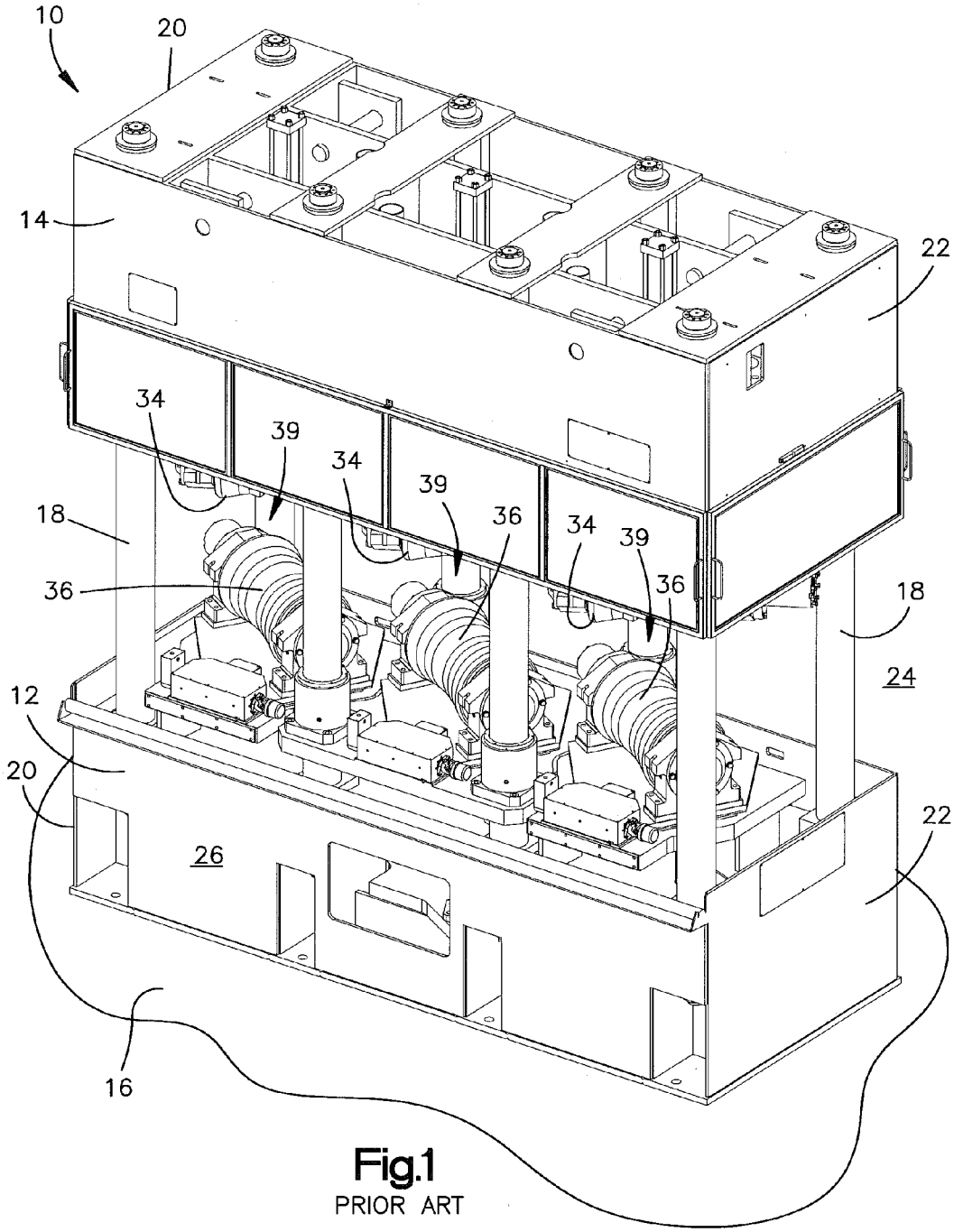
Fig.1 PRIOR ART
FIG. 1 is a perspective view of a prior art rolling machine taken from the operator side of the machine.
Figure 2:
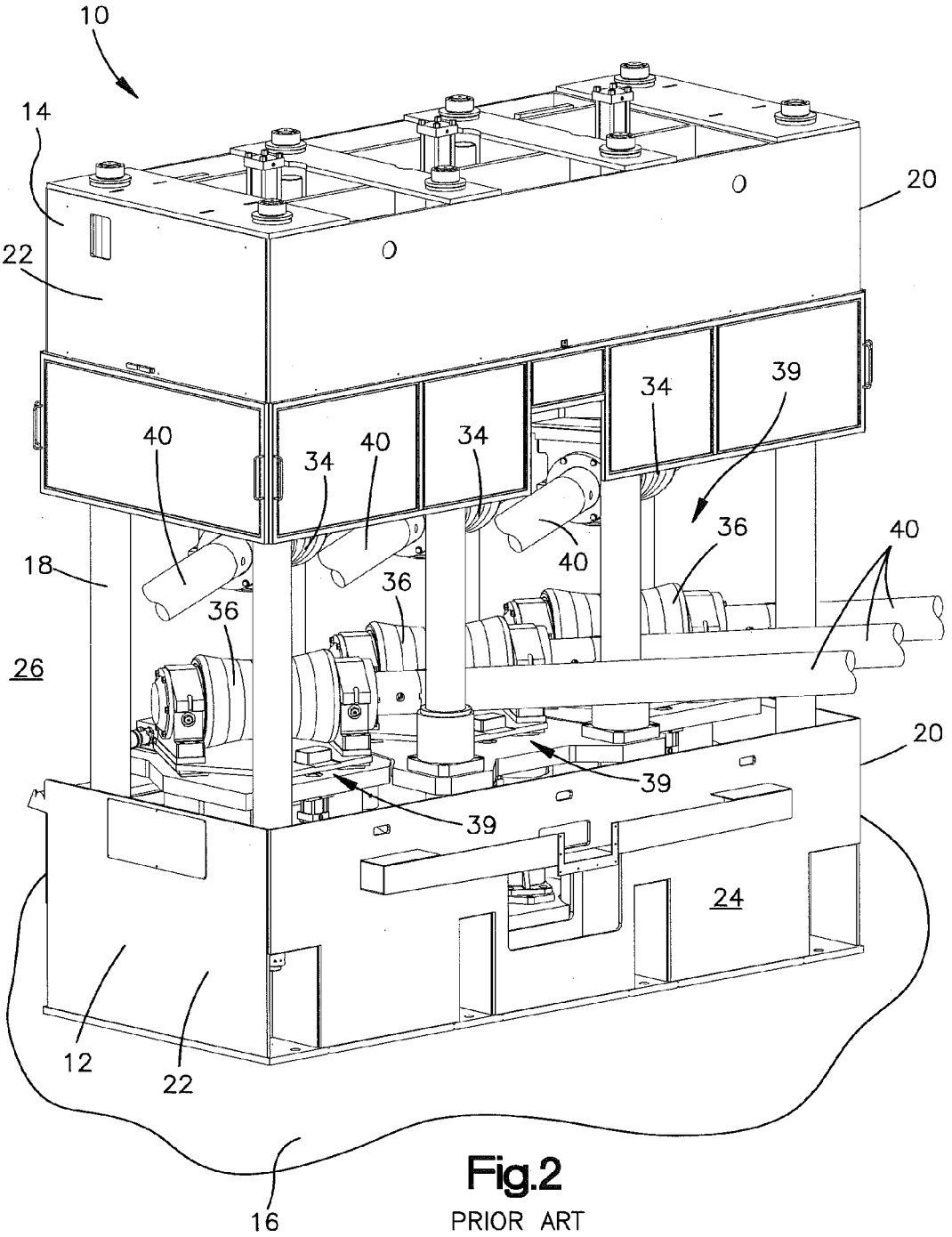
Fig.2 PRIOR ART
FIG. 2 is a perspective view of the rolling machine taken from the drive side of the machine.
Figure 3:
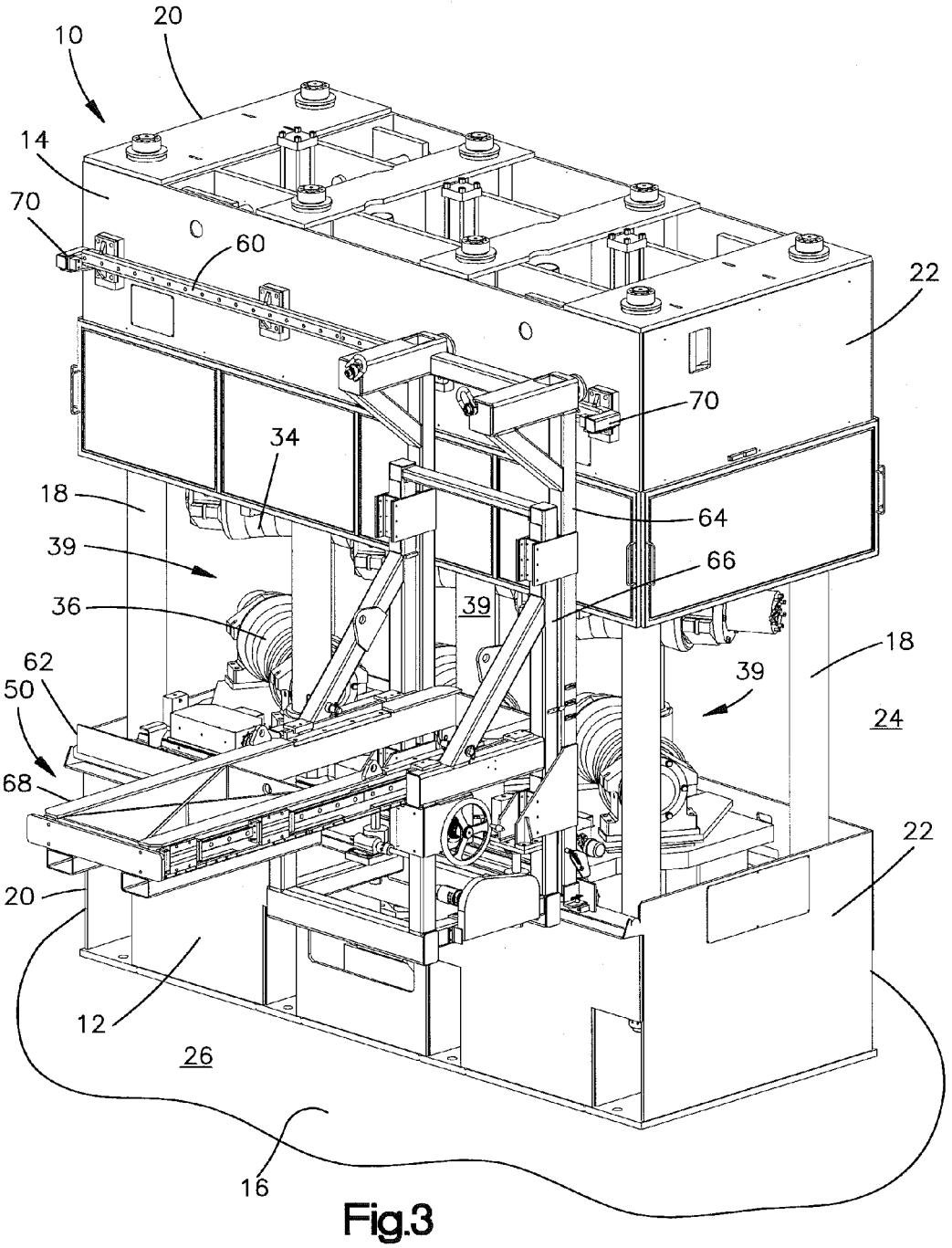
FIG. 3 is perspective view similar to FIG. 1, showing a roll change apparatus mounted on the rolling machine.

As shown in FIG. 3, a roll change apparatus 50 is provided for the rolling machine 10 described above. As best shown in the separate view of FIG. 4, the roll change apparatus 50 includes upper and lower rails 60 and 62, a sliding frame 64, and a lifting frame 66. The rails 60 and 62 are mounted on the machine 10. The sliding frame 64 is mounted on the rails 60 and 62 for movement horizontally alongside the line of roll pair locations 39. The lifting frame 66 is mounted on the sliding frame 64 for movement vertically beside each roll pair location 39. The apparatus 50 further includes a load tray 68 for carrying a pair of rolls 34 and 36. The load tray 68 is mounted on the lifting frame 66 for movement horizontally into the machine 10 at each roll pair location 39.

Figure 5:
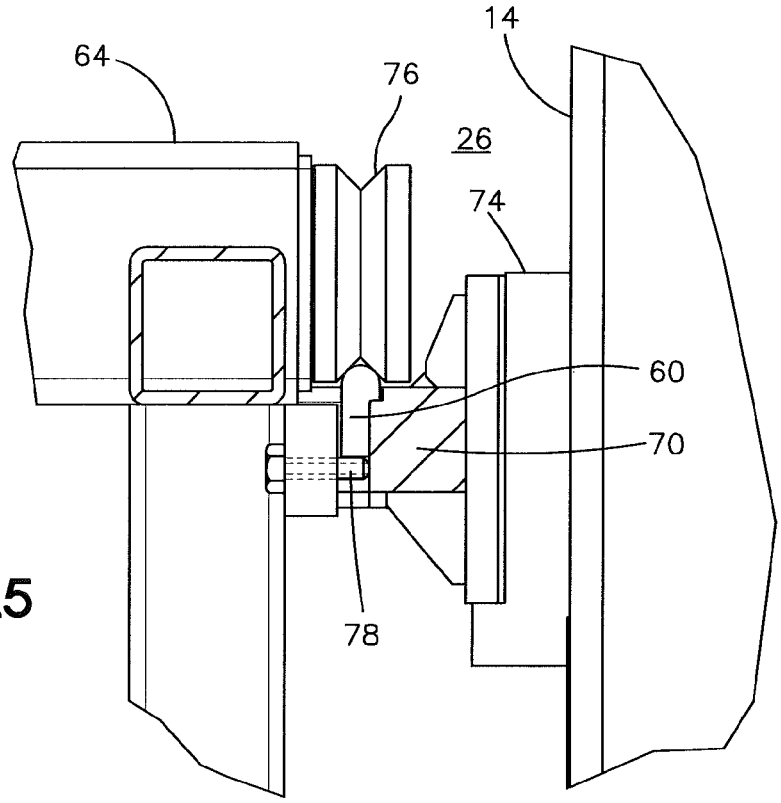
FIG. 5 is a view showing parts of the roll change apparatus in enlarged detail.

The upper rail 60 is mounted on the operator side 26 of the crown 14 in a horizontal orientation above the line of roll pair locations 39. A pair of stop members 70 are located at the opposite ends of the upper rail 60. As shown in enlarged detail in FIG. 5, the upper rail 60 in the illustrated example is mounted on a coextensive backing member 70. The backing member 70 is mounted on a row of support blocks 74 that are mounted directly on the crown 14. Grooved rollers 76 at the top of the sliding frame 64 are seated on the upper rail 60 such that the upper rail 60 and the crown 14 together bear the weight of the sliding frame 64. The sliding frame 64 in the given example is thus suspended from the crown 14.

The rollers 76 enable the sliding frame 64 to slide horizontally back and forth throughout a range of movement between the stop members 70. That range of movement reaches alongside the machine 10 in a direction parallel to the line of roll pair locations 39, and enables movement of the sliding frame 64 into and out of a position beside any selected one of the roll pair locations 39. Safety bolts 78 (FIG. 5) can be extended to project from the sliding frame 64 beneath the upper rail 60 to block unseating of the rollers 76.

Figure 6:
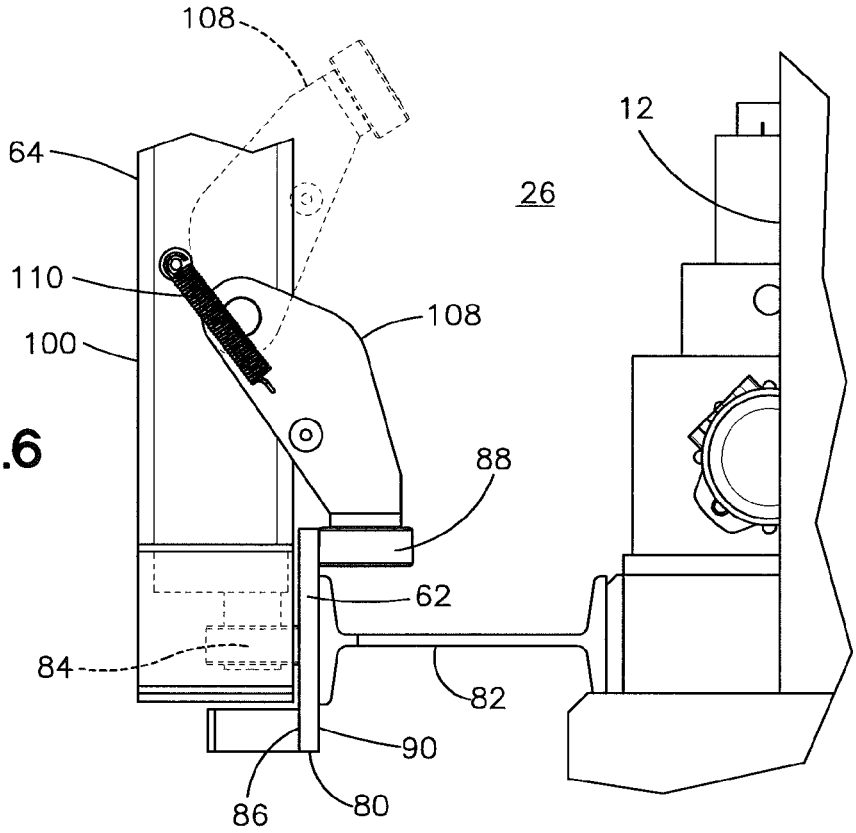
FIG. 6 is a view showing other parts of the roll change apparatus in enlarged detail.

The lower rail 62 is mounted on the operator side 26 of the base 12 below the line of roll pair locations 39, and is parallel to the upper rail 60. As shown in FIG. 6, the lower rail 62 includes a guide plate 80 attached to an I-beam 82 which in turn is attached to the base 12 of the machine 10. Outboard rollers 84 on the sliding frame 64 engage a vertical outer face 86 of the guide plate 80. Inboard rollers 88 on the sliding frame 64 engage a vertical inner face 90 of the guide plate 80. In this arrangement, the sliding frame 64 is movable alongside the line of roll pair locations 39, but is immovable in directions transverse to the line of roll pair locations 39. The upper and lower rails 60 and 62 support and guide the entire sliding frame 64 above the floor 16 throughout its full range of movement, but the lower rail 62 does not bear the weight of the sliding frame 64. Instead, the lower rail 62 serves only as a guide for movement of the sliding frame 64 alongside the machine 10.

Figure 7:
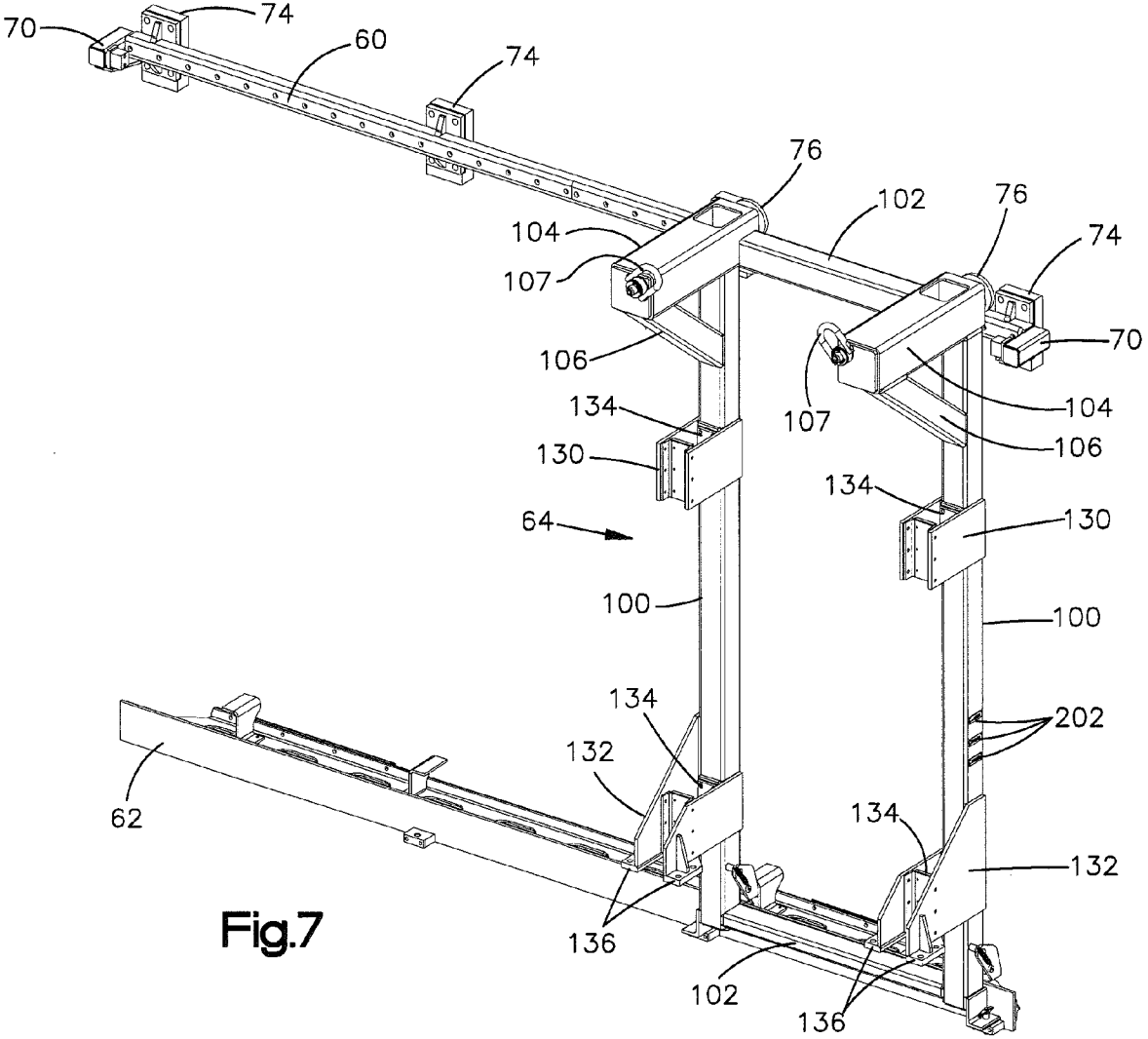
FIG. 7 is a view similar to FIG. 4, showing parts of the roll change apparatus separately from the other parts shown in FIG. 4.

As shown separately in FIG. 7, the sliding frame 64 has a pair of vertical side members 100 interconnected by horizontal end members 102. A pair of hoisting beams 104 (FIG. 7) with angled support members 106 project from the upper ends of the side members 100 in the outboard direction. The grooved rollers 76 are mounted on the hoisting beams 104 at their inboard ends. Swivel rings 107 are mounted on the outboard ends of the hoisting beams 104 for a crane (not shown) to carry the sliding frame 64 into position beside the machine 10 for placement of the grooved rollers 76 on the upper rail 60.

The outboard rollers 84 (FIG. 6) are mounted on the side members 100 at their lower ends. The inboard rollers 88 are carried on brackets 108 that are mounted on the side members 100 for pivotal movement. Each bracket 108 has an open position as shown in dashed lines in FIG. 6, and is moveable pivotally from the open position to the closed position shown in solid lines in FIG. 6. Springs 110 engage the brackets 108 to establish over-center conditions that retain the brackets 108 releasably in the open and closed positions.

Other parts of the sliding frame 64 include a pair of upper guideway elements 130 and a pair of lower guideway elements 132. The guideway elements 130 and 132 project from the side members 100 in the outboard direction, and are configured to support and guide the lifting frame 66 for movement vertically on the sliding frame 64. Bronze liners 134 are installed within the guideway elements 130 and 132 to provide low friction sliding surfaces for that purpose. The lower guideway elements 132 further have horizontal flanges 136 for attachment of the lifting frame 66, as described more fully below.

Figure 8:
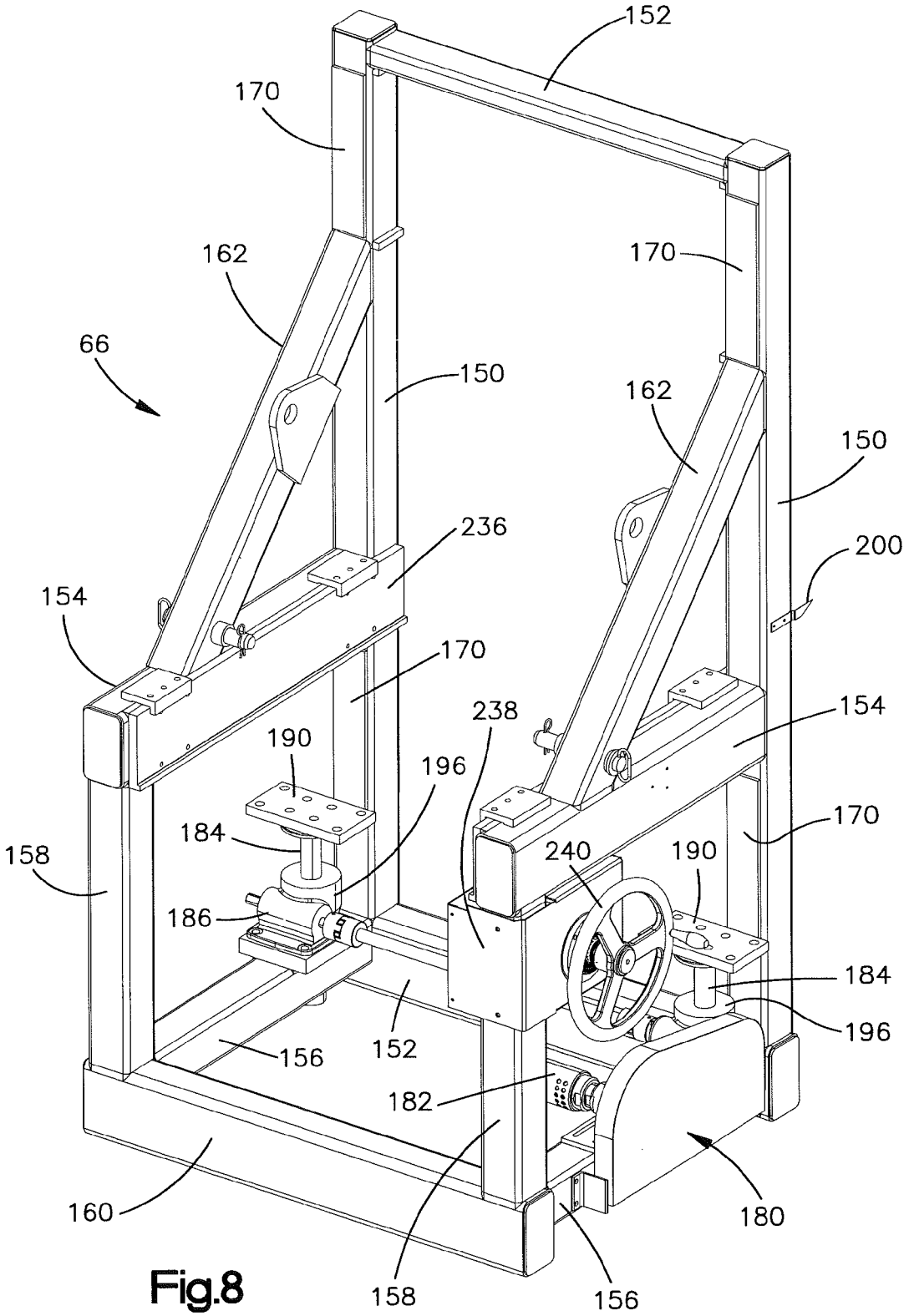
FIG. 8 also is a view similar to FIG. 4, showing a different part of the roll change apparatus separately from the other parts shown in FIG. 4.

As shown separately in FIG. 8, the lifting frame 66 also has a pair of vertical side members 150 interconnected by a pair of horizontal end members 152. A pair of tray support arms 154 project from the side members 150 in the outboard direction about mid-way up the height of the side members 150. Additional arms 156 project from the lower ends of the side members 150, and are joined with the tray support arms 154 by additional side and end members 158 and 160. A pair of angular members 162 provide further structural reinforcement for the tray support arms 154.

Figure 4:
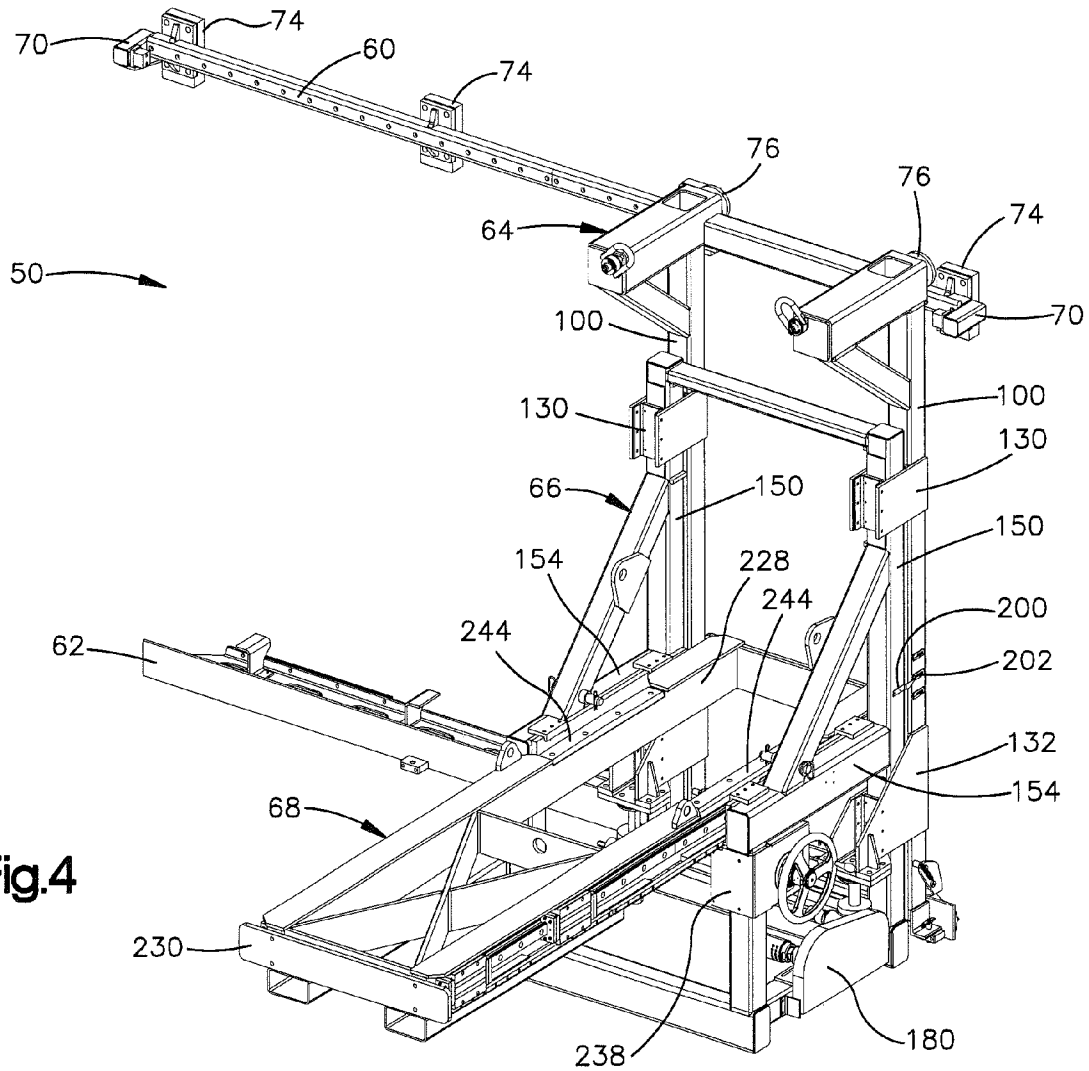
FIG. 4 is a perspective view showing the roll change apparatus separately from the rolling machine for clarity of illustration.

When the lifting frame 66 is installed on the sliding frame 64 as shown in FIG. 4, the side members 150 on the lifting frame 66 reach vertically through the guideway elements 130 and 132 on the sliding frame 64. Machined steel sliding surfaces 170 on the side members 150 (FIG. 8) adjoin the bronze liners 134 in the guideway elements 130 and 132 in low-friction sliding contact. The lifting frame 66 is then movable vertically relative to the sliding frame 64, and is movable with the sliding frame 64 alongside the line of roll pair location 39, but is immovable relative to the sliding frame 64 in horizontal directions transverse to the line of roll pair locations 39.

Figure 9:
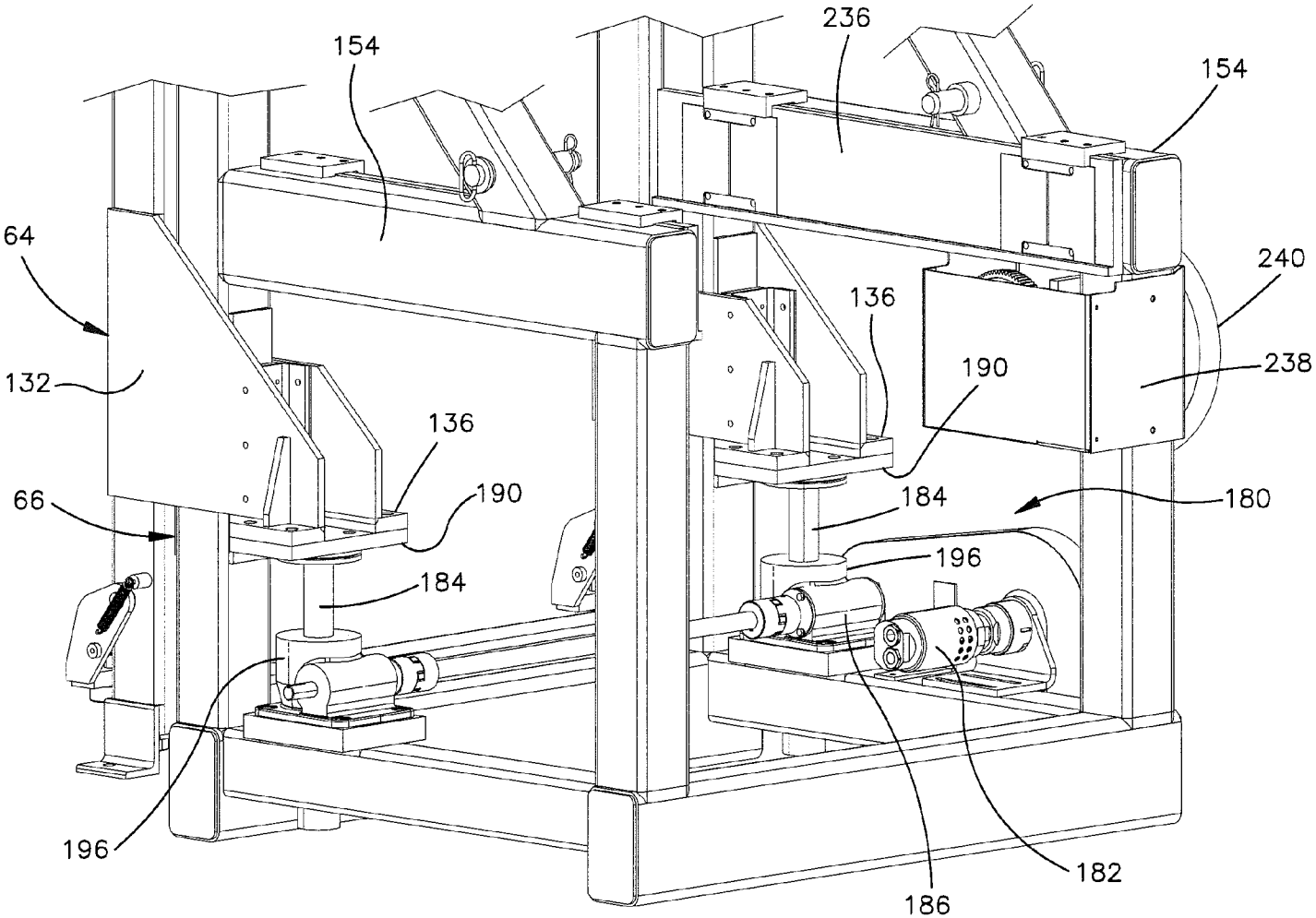
FIG. 9 is a partial view of parts shown in FIG. 8, taken from a different angle.

As further shown in FIG. 8, a lifting mechanism 180 is mounted on the lifting frame 66. This mechanism 180 functions to move the lifting frame 66 vertically on the sliding frame 64. As best shown in the view of FIG. 9, the lifting mechanism 180 in the illustrated example includes a pneumatic motor 182, a pair of jackscrews 184, and a gear assembly 186. Pads 190 on the jackscrews 184 are fastened to the underside of the flanges 136 (FIG. 7) on the sliding frame 64. In this manner the lifting frame 66 in the given example is suspended from the sliding frame 64 by the jackscrews 184.

The gear assembly 186 is driven by the motor 182 to move the jackscrews 184 relatively into or out of their housings 196. When the gear assembly 186 retracts the jackscrews 184 into the housings 196, it pulls the lifting frame 66 upward relative to the sliding frame 64. When the gear assembly 186 extends the jackscrews 184 out of the housings 196, it pushes the lifting frame 66 downward relative to the sliding frame 64. The range of such movement is indicated by a pointer 200 on the lifting frame 66 beside position markers 202 on the sliding frame 64. In the illustrated example, there are three position markers 202 for an intermediate position, an uppermost position, and a lowermost position.

Figure 10:
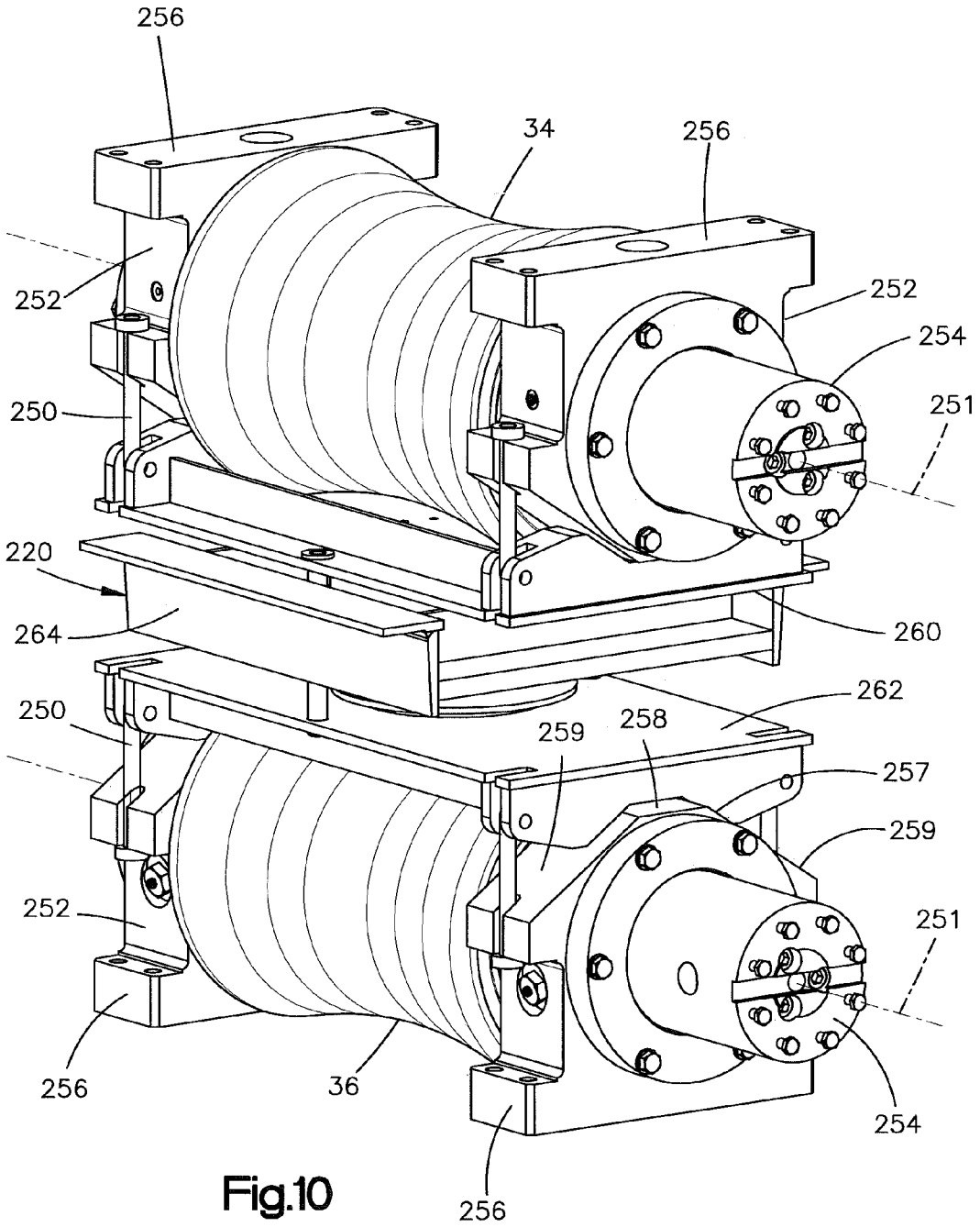
FIG. 10 is a perspective view of rolls mounted on a part of the roll change apparatus.

As noted above with reference to FIGS. 3 and 4, the load tray 68 is mounted on the lifting frame 66, and serves to carry a pair of rolls 34 and 36. More specifically, the load tray 68 is configured to carry a roll cassette 220 upon which a pair of rolls 34 and 36 can be mounted as shown in FIG. 10.

Figure 11:
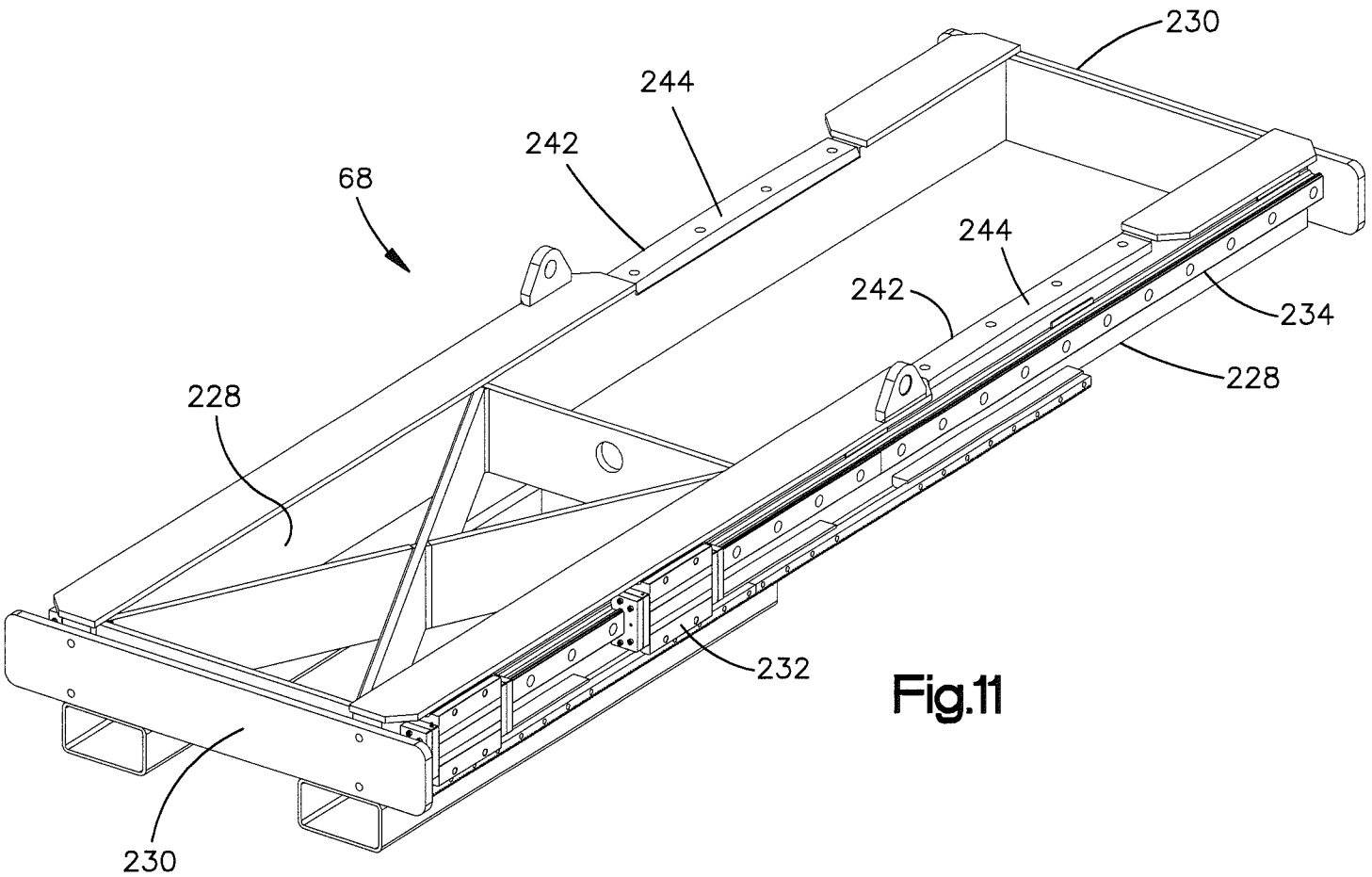
FIG. 11 is another view similar to FIG. 4, showing a part of the roll change apparatus separately from the other parts shown in FIG. 4.

As shown separately in FIG. 11, the load tray 68 in the illustrated example is a rectangular platform with side members 228 interconnected by stop members 230 at its opposite ends. Each side member 228 has a slider 232 on a track 234. The sliders 232 are configured for attachment to the lifting frame 66 on opposed surfaces 236 (FIGS. 8 and 9) of the tray support arms 154. This enables the load tray 68 to slide relative to the lifting frame 66 horizontally back and forth in opposite directions transverse to the line of roll pair locations 39. A driving mechanism 238 with a crank wheel 240 is preferably provided for moving the load tray 68 in this manner. The stop members 230 define an outer position in which the load tray 68 projects from the lifting frame 66 transversely away from the machine 10, and an inner position in which the load tray 68 projects from the lifting frame 66 transversely into the machine 10 to reach across the line of roll pair locations 39.

The load tray 68 further has rest pads 242 with rest surfaces 244 at adjacent locations atop the side members 228. The rest surfaces 244 are configured to support the roll cassette 220 (FIG. 10) from beneath when the roll cassette 220 is placed on the load tray 68. Each rest surface 244 preferably has a convex arcuate contour reaching upward from its opposite ends to a highest point mid-way between the opposite ends.

Referring again to FIG. 10, the upper and lower rolls 34 and 36 are fastened to the cassette 220 by swing bolts 250. The rolls 34 and 36 are alike, with each having an axis of rotation 251, bearing housings 252 at its opposite ends, and a drive coupling 254 projecting from one end. Each bearing housing 252 has a base 256 for connection to the machine 10 in a known manner, either at the crown 14 for an upper roll 34 or the base 12 for a lower roll 36.

Each bearing housing 252 further has peripheral surfaces defining a projection 257 configured to mate with the cassette 220 as shown in FIG. 10. In the illustrated embodiment these surfaces include a planar central surface 258 with a level orientation, and a pair of planar side surfaces 259 flanking the central surface 258 in orientations inclined toward the base 256.

Figure 12:
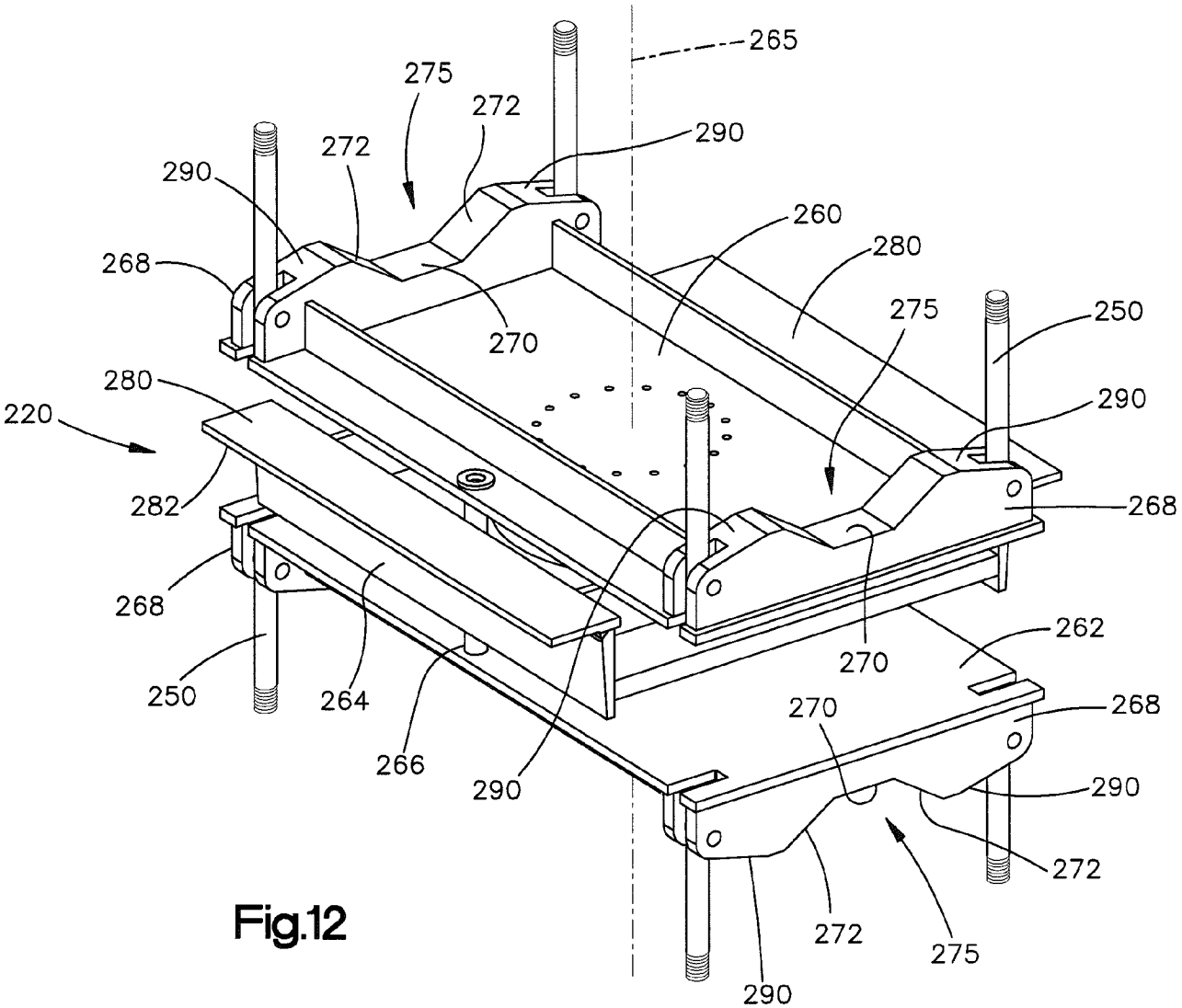
FIG. 12 is a perspective view of the part of the roll change apparatus that is shown in FIG. 10.

The cassette 220 is shown separately in FIG. 12. It is generally rectangular, and includes upper and lower panels 260 and 262 on a frame 264. A hub 266 (FIG. 13) at the center of the frame 264 supports the panels 260 and 262 for movement relative to the frame 264, and relative to one another, pivotally about a vertical axis 265. A removable locking pin 266 may be provided to block swiveling movement of the panels 260 and 262 as needed for handling and maneuvering the cassette 220.

Plates 268 are located at the opposite ends of the panels 260 and 262. Each plate 268 has peripheral surfaces including a planar central surface 270 flanked by a pair of planar intermediate surfaces 272. Those surfaces 270 and 272 face oppositely relative to the planar surfaces 258 and 259 at the projection 257 on the bearing housings 252. Each plate 268 thus defines a recessed seat 275 for receiving a projection 257 in mating surface contact. This helps to restrain the bearing housings 252 from rolling toward either side of the cassette 220. The swing bolts 250 are anchored on the plates 268, and are moveable into and out of engagement with the bearing housings 252 for attachment and detachment of the cassette 220 with the upper roll 34 from beneath and with the lower roll 36 from above.

The frame portion 264 of the cassette 220 has a pair of horizontal flanges 280 reaching along its opposite sides. The flanges 280 serve as rest pads, with planar rest surfaces 282 at their lower faces. When the cassette 220 is placed on the load tray 68, the rest surfaces 282 on the cassette 220 lie upon the rest surfaces 244 on the load tray 68. The arched and planar contours then establish line contact between the rest surfaces 244 and 282, which establishes rolling contact between the cassette 220 and the load tray 68. This enables an operator to manually rock the cassette 220 back and forth transversely to the line of roll pair locations 39 as needed for handling and maneuvering the cassette 220 and the attached rolls 34 and 36.

Figure 14:
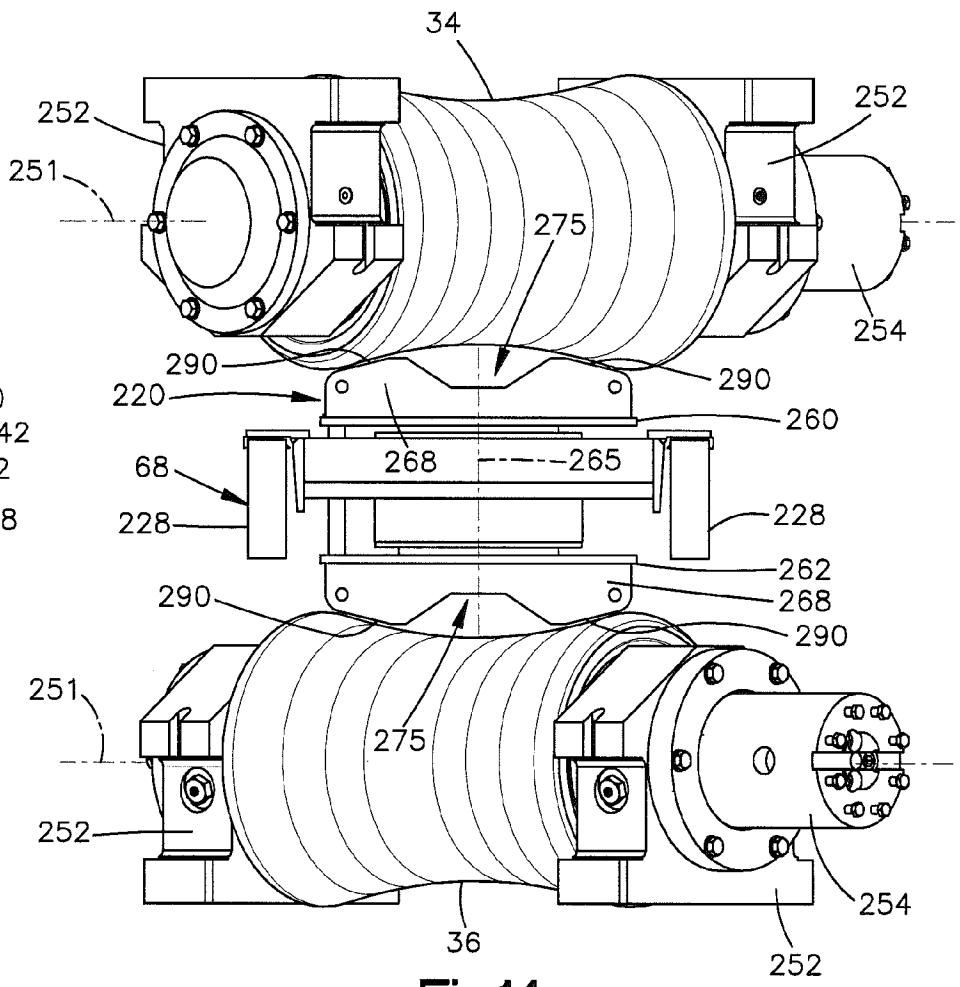
FIG. 14 is a view similar to FIG. 13, showing parts in different positions.
Figure 13:
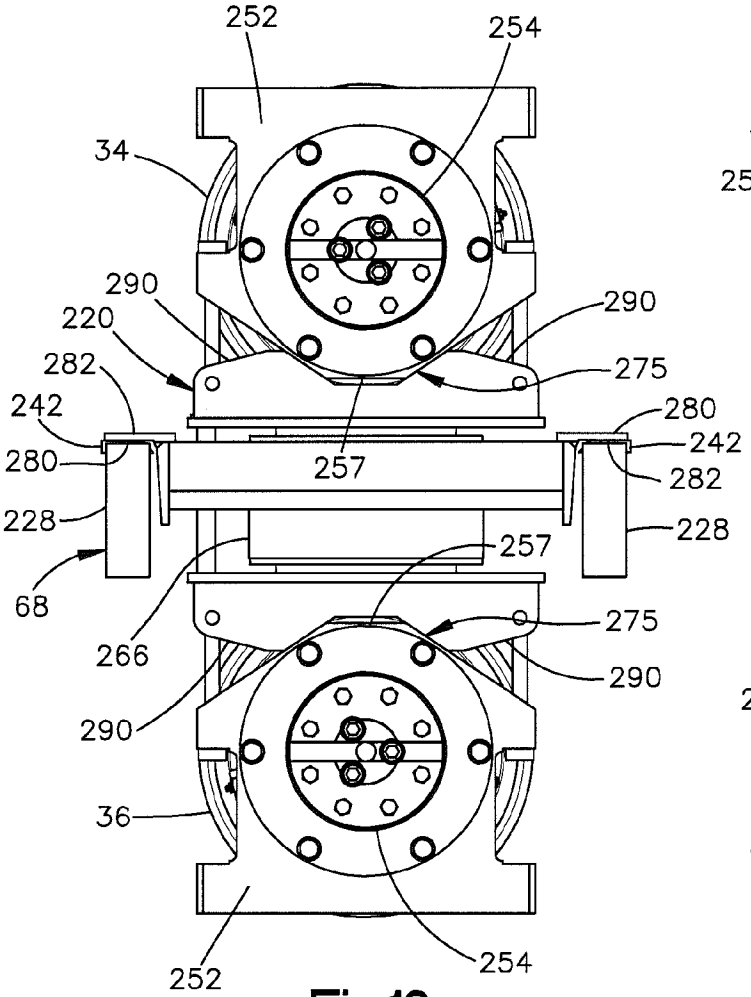
FIG. 13 is an end view showing the parts of FIG. 10 along with other parts of the roll change apparatus.

The cassette 220 can be placed on the load tray 68 with one or both of the rolls 34 and 36 attached, as shown in FIG. 13, or in an empty condition with neither roll 34 or 36 attached, as shown in FIG. 14. In the loaded condition of FIG. 13, the cassette 220 can be moved to a position bedside any one of the roll pair locations 39 by moving the sliding frame 64 along the rails 60 and 62 to the selected location 39. Although a lifting mechanism 180 is provided for lifting the weight of the lifting frame 66, the load tray 68 and the loaded cassette 220 relative to the sliding frame 64, an operator can move the sliding frame 64 horizontally along the rails 60 and 62 by pushing or pulling manually.

Having thus moved the loaded cassette 220 into position beside the selected roll pair location 39, the operator can rotate the crank wheel 240 to move the load tray 68 transversely inward to reach the roll pair location 39. The upper roll 34 can then be positioned for attachment of its bearing housings 252 to the crown 14 by actuating the motorized mechanism 180 to raise the lifting frame 66 relative to the sliding frame 64, and thereby to raise the load tray 68 to the appropriate height. The lower roll 36 can likewise be positioned for attachment of its bearing housings 252 to the base 12 by actuating the motorized mechanism 180 to lower the lifting frame 66 relative to the sliding frame 64, and thereby to lower the load tray 68 to the appropriate height. In each case, the panel 260 or 262 upon which the roll 34 or 36 is carried can be swiveled as needed for installation of the roll 34 or 36.

With the panels 260 and 262 in the pivotally aligned positions of FIG. 14, the empty cassette 220 can be moved transversely out of the roll pair location 39 after the rolls 34 and 36 have been installed, and can be moved transversely back inward for removal of the previously installed rolls 34 and 36. When the empty cassette 220 is being moved transversely inward between the previously installed rolls 34 and 36, the plates 268 at the inboard end of the cassette 220 must be moved inward far enough to reach the bearing housings 252 at the drive ends of the rolls 34 and 36. This requires the plates 268 to move inward between and past the opposed surfaces of the rolls 34 and 36. For this reason, each plate 268 further has a pair of additional peripheral surfaces 290 flanking the recessed seat 275 in orientations inclined oppositely to the intermediate surfaces 272. This provides the plates 268 with convex arched surface profiles protruding upward from the upper panel 260 and downward from the lower panel 262. The arched profiles enable the plates 268 to fit closely through the space defined by and between the arched profiles of the concave rolls 34 and 36 as shown in FIG. 14.

This written description sets forth the best mode of carrying out the invention, and describes the invention so as to enable a person or ordinary skill in the art to make and use the invention, by presenting examples of the structural elements recited in the claims. The patentable scope of the invention is defined by the claims, and may include other examples that occur to those of ordinary skill in the art. Such other examples are intended to be within the scope of the claims if they have structural elements that do not differ from the literal language of the claims, or if they have equivalent structural elements with insubstantial differences from the literal language of the claims.

What is claimed is:

1. An apparatus comprising:

a rolling machine having pairs of rolls in a horizontal line of roll pair locations, with each pair including an upper roll and a lower roll opposed across a vertical gap between the upper and lower rolls, with each upper roll having a pair of upper roll bearing housings at its opposite ends, and with each lower roll having a pair of lower roll bearing housings at its opposite ends;

a sliding frame supported for movement horizontally alongside the rolling machine in a direction parallel to the line of roll pair locations throughout a range of movement reaching alongside multiple roll pair locations in the line;

a lifting frame mounted on the sliding frame for movement with the sliding frame horizontally throughout the range of movement, and for movement vertically relative to the sliding frame beside each of the multiple roll pair locations;

a roll cassette configured for movement transversely across the line of roll pair locations into and out of the vertical gap between the upper and lower rolls at each of the multiple roll pair locations, and for attachment and detachment with a pair of upper roll bearing housings from beneath, and for attachment and detachment with a pair of lower roll bearing housings from above, when located in the vertical gap between the upper and lower rolls at each of the multiple roll pair locations; and a load tray configured to support and carry the roll cassette from beneath when the roll cassette is placed in a position resting on the load tray, the load tray being mounted on the lifting frame for movement with the lifting frame horizontally throughout the range of movement, for movement with the lifting frame vertically relative to the sliding frame, and for movement relative to the lifting frame transversely across the line of roll pair locations into and out of the vertical gap between the upper and lower rolls at each of the multiple roll pair locations and thereby to carry the roll cassette horizontally into and out of the vertical gap between the upper and lower rolls at each of the multiple roll pair locations.

2. An apparatus as defined in claim 1 further comprising a horizontal upper rail mounted on the rolling machine above the line of roll pair locations, and a parallel lower rail mounted on the rolling machine below the line of roll pair locations, with the sliding frame having rollers engaging the rails for movement along the rails horizontally throughout the range of movement, including upper rollers through which the upper rail bears the weight of the sliding frame, and lower rollers at which lower rail guides the sliding frame without bearing the weight of the sliding frame.

3. An apparatus as defined in claim 1 wherein the load tray is moveable relative to the lifting frame transversely throughout a range of movement including an outer position projecting from the lifting frame transversely away from rolling machine and an inner position projecting from the lifting frame transversely into the rolling machine to reach the line of roll pair locations, and further comprising a driving mechanism carried on the lifting frame and operatively coupled between the lifting frame and the load tray to move the load tray between the inner and outer positions.

4. An apparatus as defined in claim 1 further comprising a mechanism operatively coupled between the sliding frame and the lifting frame to move the lifting frame vertically on the sliding frame.

5. An apparatus as defined in claim 4 wherein the mechanism is connected to the lifting frame and to the sliding frame for movement with the lifting frame and the sliding frame horizontally throughout the range of movement.

6. An apparatus for use with an upper roll and a lower roll opposed to the upper roll across a vertical gap between the upper and lower rolls, with the upper roll having opposite ends and a pair of upper roll bearing housings at its opposite ends, and with the lower roll having opposite ends a pair of lower roll bearing housings at its opposite ends, the apparatus comprising:

a roll cassette having a frame, a hub, and upper and lower panels supported on the hub for movement relative to each other pivotally about a vertical axis, the panels having pivotally aligned positions in which the roll cassette is movable horizontally into the vertical gap between the upper and lower rolls, wherein the upper panel has means for attachment and detachment with the upper roll bearing housings from beneath, and the lower panel has means for attachment and detachment with the lower roll bearing housings from above, when located in the vertical gap; and a load tray configured to support the roll cassette in a seated position resting on the load tray, the load tray being further configured for movement in opposite horizontal directions into and out of the vertical gap while the roll cassette is in the seated position;

wherein the frame has a first rest pad surface that is non-rotatable relative to the frame, the load tray has a second rest pad surface that is non-rotatable relative to the load tray, and the rest pad surfaces have contours providing rolling contact for movement of the roll cassette relative to the load tray back and forth in the opposite horizontal directions in a rocking motion into and out of the seated position.

7. An apparatus as defined in claim 6 wherein one of the rest pad surfaces has a planar contour and the other rest pad surface has a convex contour providing rolling line contact at the rest pad surfaces when the roll cassette is in the seated position.

8. An apparatus as defined in claim 6 wherein the first rest pad surface on the roll cassette has the planar contour and the second rest pad surface on the load tray has the convex contour.

9. An apparatus for use with a pair of upper and lower rolls having skewed axes of rotation and concave axial profiles opposed across a vertical gap between the upper and lower rolls, the upper roll having a pair of upper roll bearing housings at its opposite ends, and the lower roll having a pair of lower roll bearing housings at its opposite ends, the apparatus comprising:

a roll cassette configured for movement into and out of the vertical gap between the upper and lower rolls, the roll cassette having a frame with a hub, and upper and lower panels supported on the hub for movement relative to each other pivotally about a vertical axis, the panels having pivotally aligned positions in which the roll cassette is movable horizontally into the vertical gap between the upper and lower rolls;

the upper panel having an end portion providing an upper recess configured as a seat to receive an upper roll bearing housing at one end of the upper roll in mating surface contact when located in the vertical gap, and further having a pair of edge surface portions flanking the upper recess and projecting downward from the upper recess to provide an arched surface profile protruding upward toward the upper recess; and the lower panel having an end portion providing a lower recess configured as a seat to receive a lower roll bearing housing at one end of the lower roll in mating surface contact when located in the vertical gap, and further having a pair of edge surface portions flanking the lower recess and projecting upward from the lower recess to provide an arched surface profile protruding downward toward the lower recess.

10. An apparatus as defined in claim 9 wherein each roll has a drive end configured for coupling with a drive shaft, and the seats are configured to mate with the bearing housings at the drive ends of the rolls.

* * * * *